US006593837B2

(12) United States Patent
Takayama

(10) Patent No.: US 6,593,837 B2
(45) Date of Patent: Jul. 15, 2003

(54) TRANSFORMER APPARATUS

(75) Inventor: Koichi Takayama, Miyagi (JP)

(73) Assignee: Sony Corporation, Tokyo (JP)

( * ) Notice: Subject to any disclaimer, the term of this patent is extended or adjusted under 35 U.S.C. 154(b) by 10 days.

(21) Appl. No.: 10/041,334

(22) Filed: Jan. 8, 2002

(65) Prior Publication Data

US 2002/0113679 A1 Aug. 22, 2002

(30) Foreign Application Priority Data

Jan. 10, 2001 (JP) ..... P2001-002853

(51) Int. Cl.[7] ..... H01F 27/02

(52) U.S. Cl. ..... 336/83; 336/212; 336/221; 336/90

(58) Field of Search ..... 336/212, 178, 336/90, 96, 83, 221, 222

(56) References Cited

U.S. PATENT DOCUMENTS 4,195,214 A * 3/1980 Gerber ..... 219/670
5,912,609 A * 6/1999 Usui et al. ..... 336/83
6,448,879 B1 * 9/2002 Kitamura ..... 336/200
6,460,244 B1 * 10/2002 Shafer et al. ..... 29/608
2002/0067237 A1 * 6/2002 Nakata et al.

* cited by examiner

*Primary Examiner*—Anh Mai
(74) *Attorney, Agent, or Firm*—Sonnenschein, Nath & Rosenthal

(57) ABSTRACT

A transformer apparatus comprises a core member including a base portion, a center core portion and at least three side core portions fixed on peripheral parts to stand thereon. The transformer apparatus further comprises a primary coil fitted around the center core portion; a first plate coil member in a frame-like shape enclosing the outside of the side core portions; a second plate core member in a frame-like shape enclosing the outside of the side core portions and being combined with the first plate coil member in a laminated state having an insulating layer therebetween. The transformer apparatus further comprises connecting coil pieces cantilevered by each side portion of the second plate coil member correspondingly to the side core portions. Each free end of the connecting coil pieces extends to enclose the outer periphery portion of a corresponding side core portion to be connected with the first plate coil member.

3 Claims, 6 Drawing Sheets

TRANSFORMER APPARATUS

CROSS REFERENCES TO RELATED APPLICATIONS

The present document is based on Japanese Priority Document JP 2001-002853, filed in the Japanese Patent Office on Jan. 10, 2001, the entire contents of which being incorporated herein by reference.

BACKGROUND OF THE INVENTION

1. Field of the Invention

The present invention relates to a transformer apparatus suitable for use as a converter transformer of a switching power supply and the like.

2. Description of the Related Art

In a converter transformer of a switching power supply, the number of turns of a primary coil and the number of turns of a secondary coil are set at a predetermined turn ratio, and thereby the converter transformer is structured to obtain a predetermined output voltage in response to an input voltage on the basis of the turn ratio. In the converter transformer, the improvement of the efficiency of the switching control circuit thereof is achieved by the setting of the switching frequency thereof to be a higher frequency, and the miniaturization of the transformer itself and the switching control circuit is achieved by the decrease of the inductance thereof.

In the converter transformer, the number of turns on the primary coil side has been decreased as a measure of the increase of the switching frequency. In the converter transformer, if, for example, the number of turns on the secondary coil side is wanted to be set at under 0.5 turn in relation to the turn ratio between the primary coil and the secondary coil to be set, its realization has been difficult owing to the configuration of the core of the converter transformer. In other words, in conventional converter transformers, the lower limit of the number of turns on the primary coil side is determined by the limit of the number of turns on the secondary coil side. Consequently, there has been a problem that the merits of the increase of the switching frequency mentioned above cannot be fully effective.

For the resolution of the aforesaid problem, Japanese Patent Publication No. 2,751,284 discloses a transformer having a core member constituting a magnetic path, which includes a first and a second magnetic leg portions that have a first and a second sectional areas and are provided with a first and a second windings, respectively, and a secondary coil constituted with the first and the second windings connected in parallel to each other to form a secondary coil. Because the thus disclosed transformer enables the selection of the turn ratio between the primary coil and the secondary coil besides the ratios of integers, it becomes possible to obtain a desired output voltage at a small voltage regulation.

Now, the aforesaid disclosed transformer has a structure in which coil wires are wound on each magnetic leg portion by predetermined numbers of turns, respectively. The disclosed transformer is small in its whole size owing to such a structure, and consequently has a problem that, when each magnetic leg portion is small the winding treatment of a coil wire to each magnetic leg portion is troublesome to make production efficiency thereof worse. The disclosed transformer also has problems such as breaking of a coil wire to be wound on each magnetic leg portion and limitation of the amount of electric current to be supplied.

SUMMARY OF THE INVENTION

Accordingly, the present invention is proposed with an object to provide a transformer apparatus including a secondary coil having a small number of turns, which enables improvement of in productivity thereof.

A transformer apparatus according to the present invention, which achieves the aforesaid object, comprises a core member, a primary coil, and a secondary coil composed of a first and a second plate coil members and a plurality of connecting coil pieces. The core member is composed of a base portion, a center core portion fixed at a center part of a principal plane (major plane) of the base portion to stand to be one body with the base portion, and at least three side core portions situated at regular intervals from each other around the center core portion in peripheral parts on the principal plane of the base portion and fixed to stand to be one body with the base portion. The primary coil is disposed at an outer periphery portion of the center core portion of the core member. The first plate coil member is formed in a basic shape of a frame-like body having side portions surrounding the outside of each side core portion respectively. The second plate coil member is also formed in the basic shape of a frame-like body having side portions surrounding the outside of each side core portion respectively, and the second plate coil member is combined with the first plate coil member with an insulating layer put between them in a laminated state. The connecting coil pieces are provided correspondingly to each side core portion of the core member in a condition of being respectively cantilevered by each side portion of the second plate coil member, and each free end of the connecting coil pieces extends to surround the outer periphery portion of each corresponding side core portion and further extends to be opposed to each adjoining side portion to be connected with the first plate coil member.

In the thus configured transformer apparatus according to the present invention, the first plate coil member and the second plate coil member are combined having the insulating layer put between them in the laminated state on the core member. In the transformer apparatus, each connecting coil piece having one end portion fixed to the second plate coil member surrounds the outer periphery portion of each side core portion, and the free end of each connecting coil piece is connected with the first plate coil member. In the transformer apparatus, the first plate coil member, a connecting coil piece and the second plate coil member constitute a unit secondary coil corresponding to each side core portion, respectively. In the transformer apparatus, by appropriate connection of each unit secondary coil, a secondary coil having the number of turns other than integers is configured as a whole. Consequently, in the transformer apparatus, the number of turns on the secondary coil side can be set bit by bit by a simple process of incorporating the first plate coil member and the second plate coil member on the core member, and then the output voltage thereof can be set in a large span.

As described above in detail, according to a transformer apparatus of the present invention, a frame-like shaped plate coil member having an n-gon shape is combined with a core member having n-pieces of side core portions in a laminated state, and opposed each side portion is connected with a connecting coil piece. Thereby, a secondary coil composed of a unit secondary coil of 1/n turn is configured. Consequently, it becomes possible to set the turn ratio of the primary coil and the secondary coil little by little, and to set the turn ratio at a value besides integer ratios. Then, the output voltage of the transformer apparatus can be set within a wide range. Consequently, the transformer apparatus can easily deal with the increase of the switching frequency, and can improve the efficiency of the switching control circuit thereof. Moreover, it can be achieved that the transformer itself and the switching control circuit are miniaturized owing to the decrease of the inductance thereof.

Furthermore, the transformer apparatus is small in size as a whole, for example, and requires no troublesome winding treatment of respective coil wires on small side core portions. Consequently, the assembling thereof becomes simple and easy, which can achieve the improvement of the productivity thereof greatly. Because the transformer apparatus is equipped with coils as plate coil members, the generation of the disadvantage of the breaking of a coil wire can be decreased, and the limitation of the amount of electric currents is relieved. Moreover, the efficiency of heat dissipation becomes higher and the degree of precision can also be heightened greatly.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DESCRIPTION OF THE PREFERRED EMBODIMENTS

Figure 1:
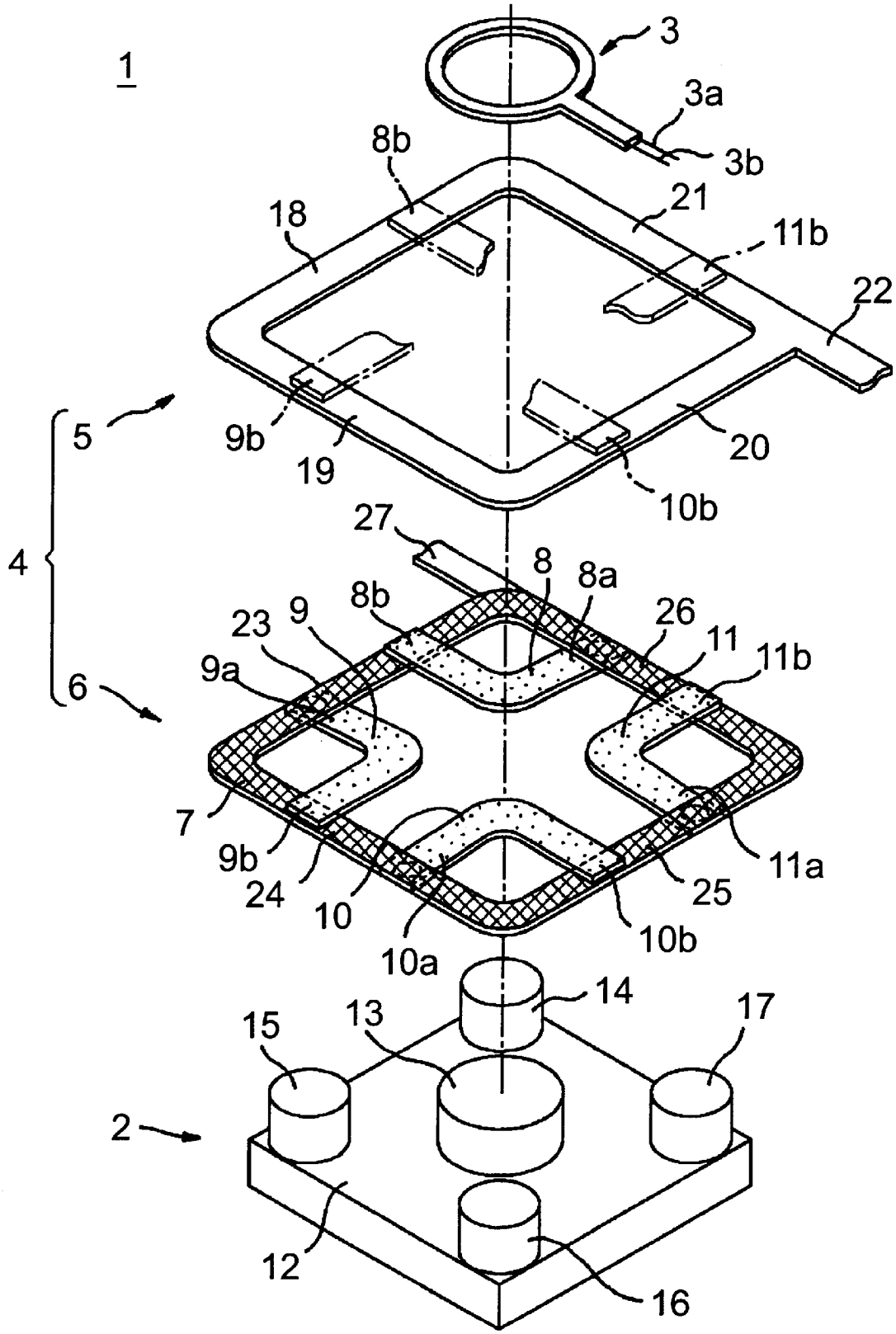
FIG. 1 is a disassembled perspective view of principal parts of a transformer apparatus shown as an embodiment of the present invention.

In the following, the attached drawings are referred while the embodiments of the present invention are described in detail. A transformer apparatus 1 shown as an embodiment is used as a converter transformer of a switching power supply having a switching frequency equal to 500 kHz to 1 MHz or more. As shown in FIG. 1, the transformer apparatus 1 is configured to include a core member 2, a primary coil 3, a secondary coil 4 composed of a first plate coil member 5 and a second plate coil member 6, an insulating layer 7 for the insulation of the first plate coil member 5 from the second plate coil member 6, and a first connecting coil piece 8 to a fourth connecting coil piece 11, the details of which will be described later. In the transformer apparatus 1, the first plate coil member 5 and the second plate coil member 6 are combined having the insulating layer 7 put between them in a laminated state on a principal plane of the core member 2. Incidentally, a not shown another core member having a shape symmetrical to the shown core member 2 is provided on an upper position of the first plate coil member 5 to be a pair of the upper side one and the lower side one, and they are combined to confront each core portion each other that will be described later.

The core member 2 is formed from a ferrite material, for example, an Mn—Zn series ferrite, preferably a ferrite material having a core loss of 800 kw/m$^3$ or less at 1 MHz, 50 mT, 100° C. On the core member 2, a center core portion 13 in a shape of a projecting portion having a circular cross section is fixed at the central part of a square base portion 12 to stand in one body with the base portion 12. Moreover, a first side core portion 14 to a fourth side core portion 17 situated at each corner portion are fixed to stand in one body with the base portion 12. On the core member 2, although the details will be described later, the center core portion 13 constitutes the core on the primary coil side, and the first side core portion 14 to the fourth side core portion 17 constitute the cores on the secondary coil side as a whole.

Each of the first side core portion 14 to the fourth side core portion 17 is also in a shape of a projecting portion having a circular cross section, and they are fixed on the base portion 12 to stand thereon and are situated at regular intervals from the center core portion 13, and situated at regular intervals from each other. The sectional area of each of the first side core portion 14 to the fourth side core portion 17 is formed to be the same one another and to be a quarter of that of the center core portion 13. Because the cross sections of the first side core portion 14 to the fourth side core portion 17 of the core member 2 are formed to be circles, the copper losses of coils are decreased.

The primary coil 3 is wound around the outer periphery portion of the center core portion 13, and the number of turns is, for example, five turns, though the details thereof are omitted. The primary coil 3 is incorporated into the core member 2 with being insulated from the first plate coil member 5 and the second plate coil member 6, which will be described in detail later. From the primary coil 3, a pair of leads 3*a* and 3*b* is drawn out to the outside of the core member 2 to be connected with a not shown primary side circuit section.

The first plate coil member 5 is formed by, for example, the press-cut working of a metallic plate such as a copper sheet or the like. The first plate coil member 5 is, as a whole, shaped in substantially a frame-like body having an opening portion sufficient for enclosing each of the first side core portion 14 to the fourth side core portion 17 of the core member 2 by a first side portion 18 to a fourth side portion 21 of the first plate coil member 5. A first terminal side portion 22 to be connected with a not shown secondary circuit portion is formed on the fourth side portion 21 of the first plate coil member 5.

The first side portion 18 extends on the outside of a portion between the first side core portion 14 and the second side core portion 15, and the first side portion 18 is bent along the outer periphery portion of the second side core portion 15 at a right angle to be continuously connected with a second side portion 19. The second side portion 19 extends on the outside of a portion between the second side core portion 15 and the third side core portion 16, and the second side portion 19 is bent along the outer periphery portion of the third side core portion 16 at a right angle to be continuously connected with a third side portion 20. The third side portion 20 extends on the outside of a portion between the third side core portion 16 and the fourth side core portion 17, and the third side portion 20 is bent along the outer periphery portion of the forth side core portion 17 at a right angle to be continuously connected with the fourth side portion 21.

The fourth side portion 21 extends on the outside of a portion between the fourth side core portion 17 and the first side core portion 14, and the fourth side portion 21 is bent along the outer periphery portion of the first side core portion 14 at a right angle to be continuously connected with the first side portion 18. The first terminal side portion 22 is formed to extend in a single body with the fourth side portion 21 orthogonally to the third side portion 20.

The second plate coil member 6 is also formed by, for example, the press-cut working of a metallic plate such as a copper sheet or the like. The second plate coil member 6 is, as a whole, shaped in substantially a frame-like body having an opening portion sufficient for enclosing each of the first side core portion 14 to the fourth side core portion 17 of the core member 2 by a first side portion 23 to a fourth side portion 26 of the second plate coil member 6. A second terminal side portion 27 to be connected with the not shown secondary circuit portion is formed on the fourth side portion 26 of the second plate coil member 6. The size of the external form of the second plate coil portion 6 is formed to be substantially the same as that of the first plate coil member 5.

The first side portion 23 extends on the outside of a portion between the first side core portion 14 and the second side core portion 15, and the first side portion 23 is bent along the outer periphery portion of the second side core portion 15 at a right angle to be continuously connected with a second side portion 24. The second side portion 24 extends on the outside of a portion between the second side core portion 15 and the third side core portion 16, and the second side portion 24 is bent along the outer periphery portion of the third side core portion 16 at a right angle to be continuously connected with a third side portion 25. The third side portion 25 extends on the outside of a portion between the third side core portion 16 and the fourth side core portion 17, and the third side portion 25 is bent along the outer periphery portion of the forth side core portion 17 at a right angle to be continuously connected with the fourth side portion 26.

The fourth side portion 26 extends on the outside of a portion between the fourth side core portion 17 and the first side core portion 14, and the fourth side portion 26 is bent along the outer periphery portion of the first side core portion 14 at a right angle to be continuously connected with the first side portion 23. The second terminal side portion 27 is formed to extend in a body with the fourth side portion 26 orthogonally to the first side portion 23. The second terminal side portion 27 is situated to be opposed to the first terminal side portion 22 on the first coil plate member 5 side in a state that the second plate coil member 6 and the first plate coil member 5 are combined.

The insulating layer 7 is formed on a joint surface of the second plate coil member 6 with the first plate coil member 5. The insulating layer 7 is formed by the coating of an insulating material, or by junction of an insulating sheet formed in the same shape of that of the second plate coil member 6, or by other methods.

Figure 2:
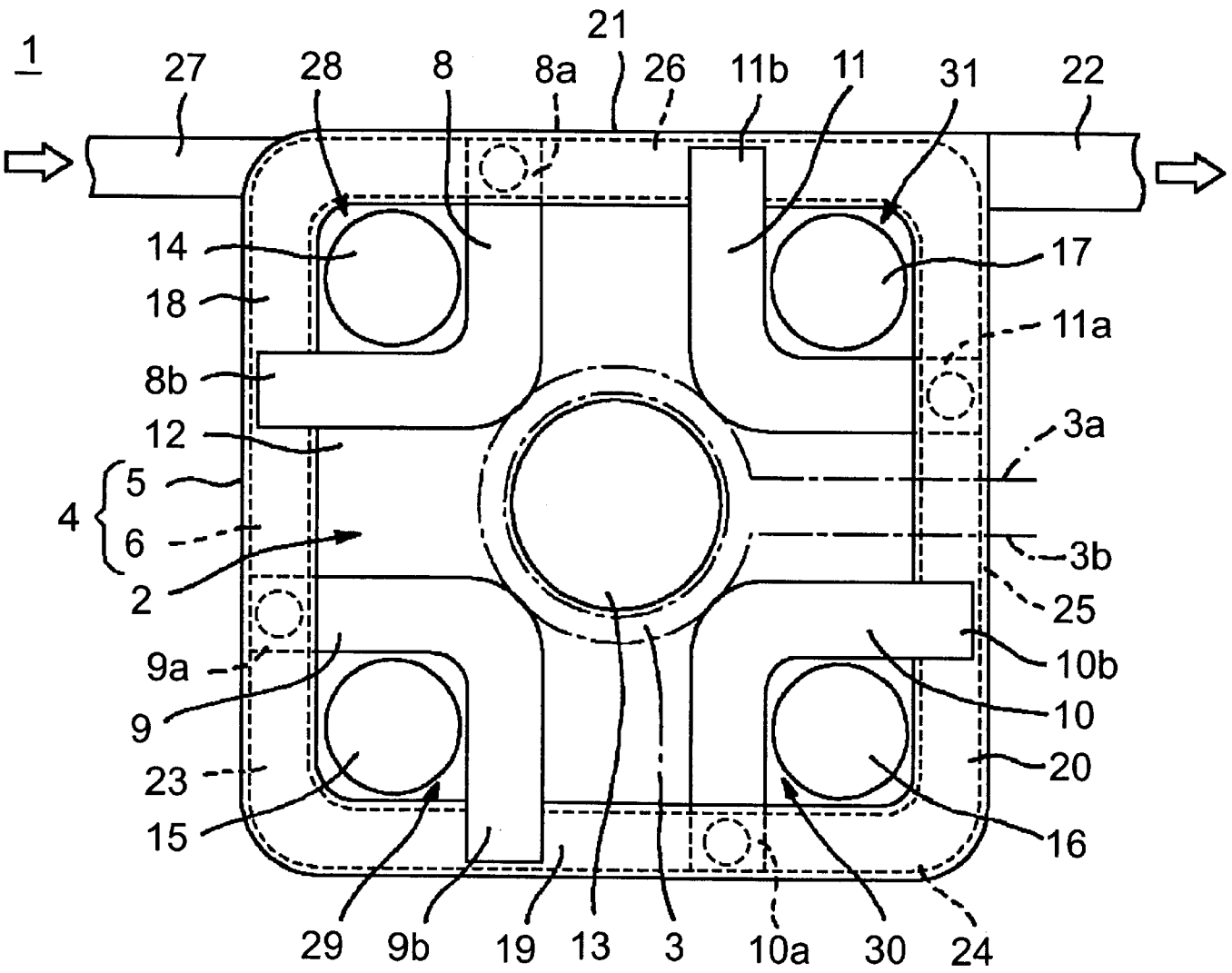
FIG. 2 is a plan view of the principal parts of the same transformer apparatus.

As shown in FIG. 1 and FIG. 2, the first connecting coil piece 8 to the fourth connecting coil piece 11 are fixed on the first side portion 23 to the fourth side portion 26 of the second plate coil member 6 in a severally cantilevered state by the soldering or the like of their base portions 8*a*–11*a* to be kept in an electrically connected state with the first side portion 23 to the fourth side portion 26. The first connecting coil piece 8 to the fourth connecting coil piece 11 are respectively made of a metallic plate such as a copper sheet or the like as their material, and are respectively formed in an L-letter shape having integrated two sides respectively longer than the external diameter of each of the side core portions 14–17 in an orthogonally crossed state to each other. Insulating layers are formed on the surfaces of the first connecting coil piece 8 to the fourth connecting coil piece 11 except for each of the base portions 8*a*–11*a*.

The base portion 8*a* of the first connecting coil piece 8 is fixed on the fourth side portion 26 of the second plate coil member 6. The cornering portion of the first connecting coil piece 8 is opposed to the cornering portion where the first side portion 23 and the fourth side portion 26 cross to each other. A free end portion 8*b* of the first connecting coil piece 8 extends on the surface of the first side portion 23 of the second plate coil member 6 where the insulating layer 7 is formed. The first connecting coil piece 8 constitutes a first unit secondary coil 28, the details of which will be described later, by enclosing the outer periphery portion of the first side core portion 14 together with the first side portion 23 and the fourth side portion 26 of the second plate coil portion 6 in a state that the second plate coil portion 6 is combined with the core member 2 as it will be describe later.

A base portion 9*a* of the second connecting coil piece 9 is fixed on the first side portion 23 of the second plate coil member 6. The cornering portion of the second connecting coil piece 9 is opposed to the cornering portion where the first side portion 23 and the second side portion 24 cross to each other. A free end portion 9*b* of the second connecting coil piece 9 extends on the surface of the second side portion 24 of the second plate coil member 6 where the insulating layer 7 is formed. The second connecting coil piece 9 constitutes a second unit secondary coil 29, the details of which will be described later, by enclosing the outer periphery portion of the second side core portion 15 together with the first side portion 23 and the second side portion 24 of the second plate coil portion 6 in the state that the second plate coil portion 6 is combined with the core member 2 as it will be describe later.

A base portion 10*a* of the third connecting coil piece 10 is fixed on the second side portion 24 of the second plate coil member 6. The cornering portion of the third connecting coil piece 10 is opposed to the cornering portion where the second side portion 24 and the third side portion 25 cross to each other. A free end portion 10*b* of the third connecting coil piece 10 extends on the surface of the third side portion 25 of the second plate coil member 6 where the insulating layer 7 is formed. The third connecting coil piece 10 constitutes a third unit secondary coil 30, the details of which will be described later, by enclosing the outer periphery portion of the third side core portion 16 together with the second side portion 24 and the third side portion 25 of the second plate coil portion 6 in the state that the second plate coil portion 6 is combined with the core member 2 as it will be describe later.

The base portion 11*a* of the fourth connecting coil piece 11 is fixed on the third side portion 25 of the second plate coil member 6. The cornering portion of the fourth connecting coil piece 11 is opposed to the cornering portion where the third side portion 25 and the fourth side portion 26 cross to each other. A free end portion 11*b* of the fourth connecting coil piece 11 extends on the surface of the fourth side portion 26 of the second plate coil member 6 where the insulating layer 7 is formed. The fourth connecting coil piece 11 constitutes a fourth unit secondary coil 31, the details of which will be described later, by enclosing the outer periphery portion of the fourth side core portion 17 together with the third side portion 25 and the fourth side portion 26 of the second plate coil portion 6 in the state that the second plate coil portion 6 is combined with the core member 2 as it will be describe later.

The transformer apparatus 1 is assembled in conformity with the following process. At first, the second plate coil member 6, the first plate coil member 5 and the primary coil 3 are combined in this order on the base portion 12, on which each of the core portions 13–17 have been formed, of the lower side core member 2. After that, the not shown upper side core member is combined with the lower side core member 2. The transformer apparatus 1 can efficiently be combined by the employment of a combination method in which the first plate coil member 5 and the second plate coil member 6 are previously combined and after that the combined first and second plate coil members 5 and 6 are combined with the core member 2. It is needless to say that the assembling method of the transformed apparatus 1 is not limited to the assembling method in which the first plate coil member 5 and the second plate coil member 6 are assembled in conformity with the aforesaid assembling method.

The second plate coil member 6 is joined with the under surface of the first plate coil member 5 having the insulating layer 7 put between them as a joint surface in such a way that each of the aforesaid corresponding side portions 18–21 and 23–26 are respectively laid upon another. The insulating layer 7 keeps the opposed joint surfaces of the first plate coil member 5 and the second plate coil member 6 at an insulated state. The free ends 8*b*–11*b* of the respective first to the fourth connecting coil pieces 8–11 are in a state of being put between the first plate coil member 5 and the second plate coil member 6.

As shown in FIG. 2, the free ends 8*b*–11*b* of each of the first connecting coil piece 8 to the fourth connecting coil piece 11 are drawn out on the corresponding surfaces of the first side portion 18 to the fourth side portion 21 of the first plate coil member 5. The under surfaces of the free ends 8*b*–11*b*, on which no insulating layer is formed, of each of the first connecting coil piece 8 to the fourth connecting coil piece 11 are contacted with corresponding one of the first to the fourth side portions 18–21 of the first plate coil member 5.

That is, as shown in FIG. 2, the free end portion 8*b* of the first connecting coil piece 8 is drawn out on the upper surface side of the first side portion 18 of the first plate coil member 5, and is contacted with it. The free end portion 8*b* of the first connecting coil piece 8 is electrically and mechanically fixed on the first side portion 18 by soldering, spot welding or other methods to constitute the first unit secondary coil 28 together with the first plate coil member 5 and the second plate coil member 6 as mentioned above. The first side core portion 14 penetrates the first unit secondary coil 28 in a state that the first plate coil member 5 and the second plate coil member 6 are combined with the core member 2.

The free end portion 9*b* of the second connecting coil piece 9 is also drawn out on the upper surface side of the second side portion 19 of the first plate coil member 5, and is contacted with it. The free end portion 9*b* of the second connecting coil piece 9 is electrically and mechanically fixed on the second side portion 19 by soldering, spot welding or other methods to constitute the second unit secondary coil 29 together with the first plate coil member 5 and the second plate coil member 6 as mentioned above. The second side core portion 15 penetrates the second unit secondary coil 29 in the state that the first plate coil member 5 and the second plate coil member 6 are combined with the core member 2.

The free end portion 10*b* of the third connecting coil piece 10 is also drawn out on the upper surface side of the third side portion 20 of the first plate coil member 5, and is contacted with it. The free end portion 10*b* of the third connecting coil piece 10 is electrically and mechanically fixed on the third side portion 20 by soldering, spot welding or other methods to constitute the third unit secondary coil 30 together with the first plate coil member 5 and the second plate coil member 6 as mentioned above. The third side core portion 16 penetrates the third unit secondary coil 30 in the state that the first plate coil member 5 and the second plate coil member 6 are combined with the core member 2.

The free end portion 11*b* of the fourth connecting coil piece 11 is also drawn out on the upper surface side of the fourth side portion 21 of the first plate coil member 5, and is contacted with it. The free end portion 11*b* of the fourth connecting coil piece 11 is electrically and mechanically fixed on the fourth side portion 21 by soldering, spot welding or other methods to constitute the fourth unit secondary coil 31 together with the first plate coil member 5 and the second plate coil member 6 as mentioned above. The fourth side core portion 17 penetrates the fourth unit secondary coil 31 in the state that the first plate coil member 5 and the second plate coil member 6 are combined with the core member 2.

Figure 3:
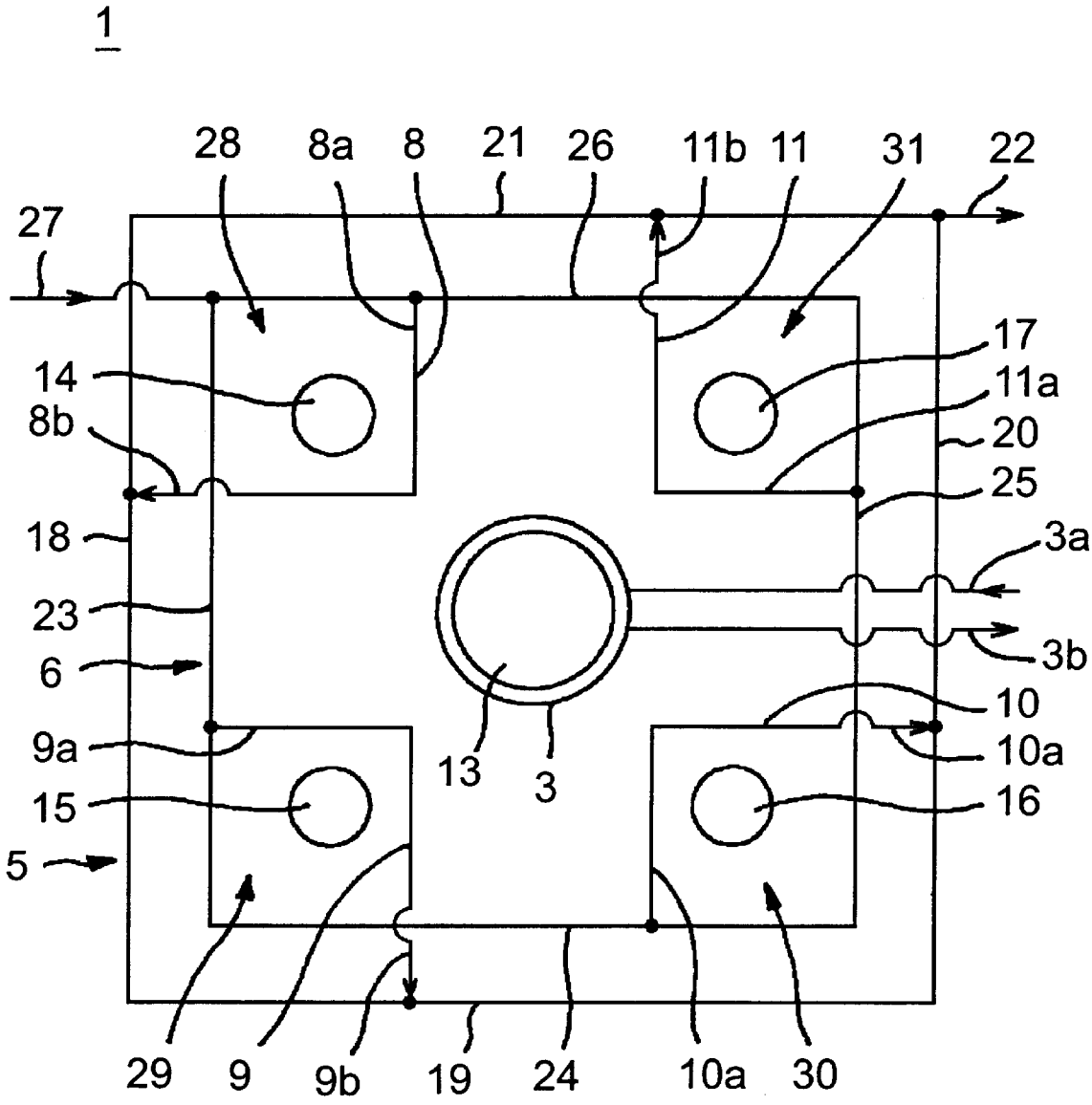
FIG. 3 is a wiring diagram of the same transformer apparatus.

In the thus configured transformer apparatus 1, the primary coil 3 of five turns is combined with the center core portion 13 to constitute the primary side. In the transformer apparatus 1, the first side core portion 14 to the fourth side core portion 17 and the first plate coil member 5 and the second plate coil member 6 surrounding the outer periphery portions of these side core portions 14–17 constitute the secondary side. In the transformer apparatus 1, the first plate coil member 5 and the second plate coil member 6 constitute the secondary coil 4 of one turn which is the apparent minimum number of turns. As shown in FIG. 3, the secondary coil 4 is divided to be composed of the first unit secondary coil 28 to the fourth unit secondary coil 31, all being connected in parallel to one another. Consequently, the secondary coil 4 is configured to have the number of turns of ¼ (0.25) turn as a whole. Therefore, in the transformer apparatus 1, the secondary coil 4 outputs an induced voltage corresponding to the ¼ turn per an applied voltage corresponding to the one turn of the primary coil 3.

In the transformer apparatus 1, as described above, the first side core portion 14 to the fourth side core portion 17 are respectively equipped with the first unit secondary coil 28 to the fourth unit secondary coil 31, all being of 0.25 turn. Accordingly, it becomes possible to constitute a secondary coil 4 having 0.5 turn or 0.75 turn besides 0.25 turn by combining the first unit secondary coil 28 to the fourth unit secondary coil 31 suitably.

Figure 4:
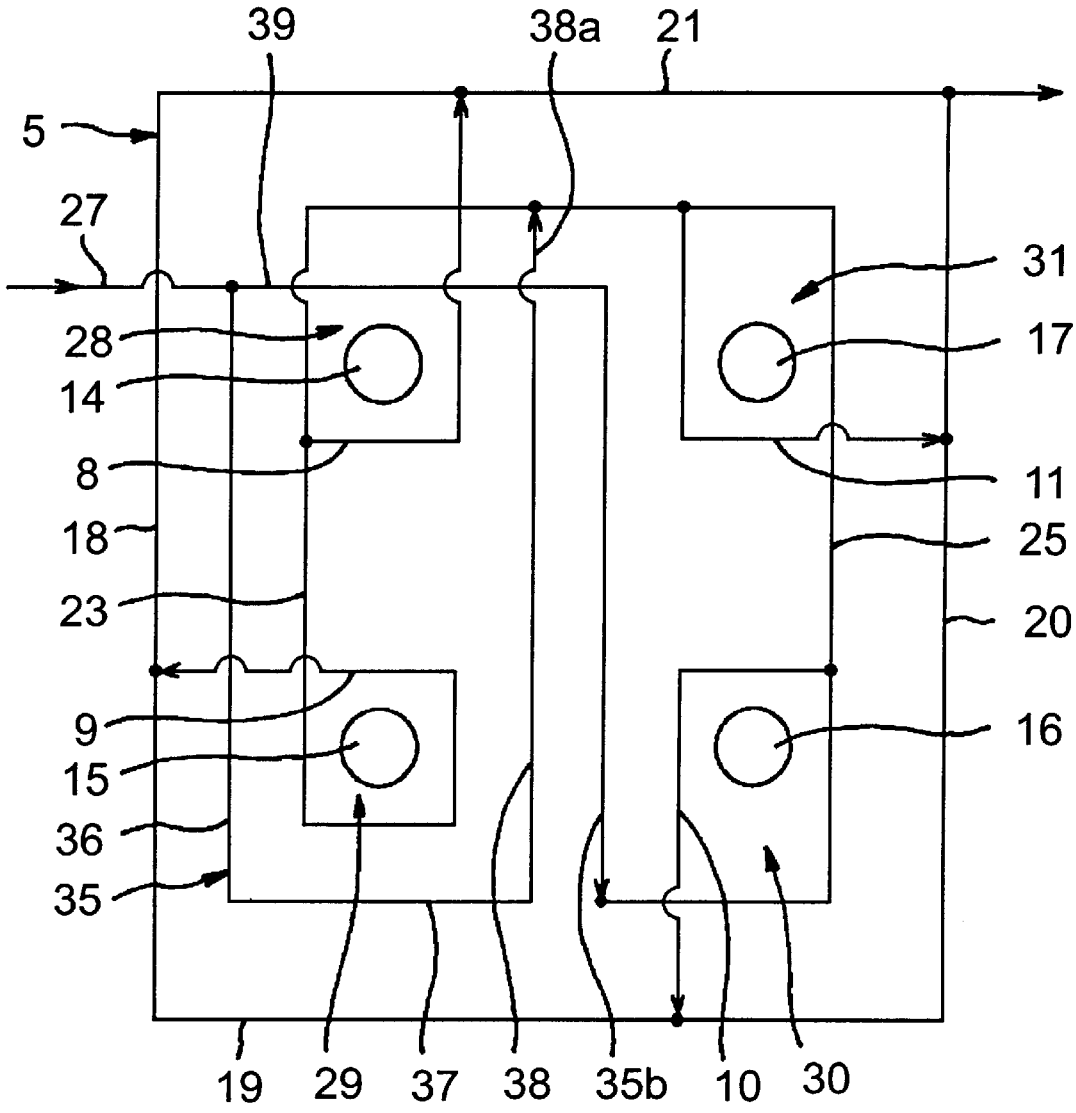
FIG. 4 is another wiring diagram of the same transformer apparatus.

The transformer apparatus 1 may be connected, for example, as shown in FIG. 4, such that the first unit secondary coil 28 and the second unit secondary coil 29 are connected in series to each other and the third unit secondary coil 30 and the fourth unit secondary coil 31 are connected in parallel to each other and further these serial body and parallel body are connected in series to each other. By such a connection, the transformer apparatus 1 constitutes a secondary coil of the serial body composed of the first unit secondary coil 28 and the second unit secondary coil 29 of 0.25T+0.25T=0.5T. The transformer apparatus 1 constitutes a secondary coil of the parallel body composed of the third unit secondary coil 30 and the fourth unit secondary coil 31 of 0.25T. Consequently, the transformer apparatus 1 constitutes a secondary coil 4 of 0.5T+0.25T=0.75T as a whole. The transformer apparatus 1 outputs an induced voltage corresponding to the 0.75 turn of the secondary coil 4 per an applied voltage corresponding the 1 turn of the primary coil 3.

Figure 5:
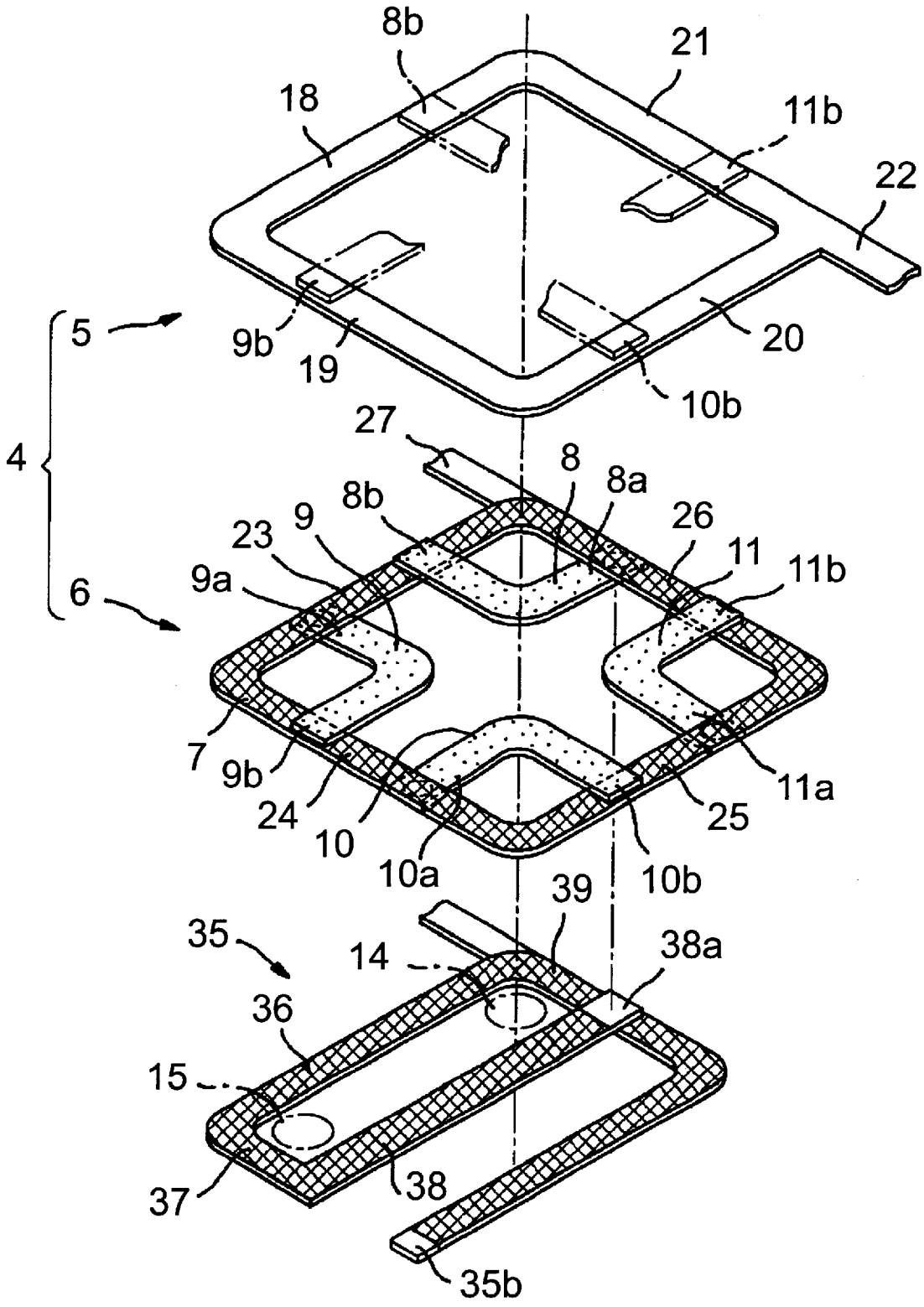
FIG. 5 is another disassembled perspective view of the principal part of the same transformer apparatus.

For the implementation of the aforesaid connection structure, in the transformer apparatus 1, for example, a third plate coil member 35 shown in FIG. 5 is combined with the first plate coil member 5 and the second plate coil member 6. The third plate coil member 35 is formed in a frame-like shape composed of a first side portion 36 to a fourth side portion 39, including an insulating layer on the surface being a joint surface with the second plate coil member 6. The first side portion 36 is configured to have a length sufficient for extending on the outside of the first side core portion 14 and the second side core portion 15. A second side portion 37 is formed to be bent at a right angle at the end portion of the first side portion 36 correspondingly to the second side core portion 15.

A third side portion 38 is formed to be bent at a right angle at the end portion of the second side portion 37 to be opposed to the first side portion 36. The third side portion 38 is configured to have a length sufficient for extending on the outside of the first side core portion 14 and the second side core portion 15. The insulating layer is exfoliated at a free end 38*a* of the third side portion 38. The fourth side portion 39 is bent at a right angle at the end portion of the first side portion 36 correspondingly to the first side core portion 14 to be opposed to the second side portion 37. The free ends of the third side portion 38 and the forth side portion 39 are opposed to each other to overlap each other in an orthogonally crossed state. The free ends are held to be insulated to each other.

The thus configured third plate coil member 35 is combined with the core member 2 such that the first side core portion 14 and the second side core portion 15 commonly penetrate the inner space enclosed by the first side portion 36 to the fourth side portion 39. The free end 38*a* of the side portion 38 of the third plate coil member 35 is drawn out on the fourth side portion 26 of the second plate coil member 6 to be contacted with the fourth side portion 21 of the first plate coil member 5 in the state that the first plate coil member 5 and the second plate coil member 6 are combined. The free end 38*a* of the third side portion 38 of the third plate coil member 35 and the fourth side portion 21 are mechanically and electrically fixed to each other by soldering, spot welding or other methods.

Consequently, the third plate coil member 35 constitutes a unit secondary coil of 0.5T applied on the first side core portion 14 and the second side core portion 15 as one core. In other words, the third plate coil member 35 constitutes a serial body composed of the serial connection of the first unit secondary coil 28 and the second unit secondary coil 29. The transformer apparatus 1 has a configuration in which the serial body of the first unit secondary coil 28 and the second unit secondary coil 29 and the parallel body of the third unit secondary coil 30 and the fourth unit secondary coil 31 are connected with the first plate coil member 5 in series by means of the third plate coil member 35.

In the thus configured transformer apparatus 1, an induced voltage according to the turn ratio of the number of turns of the primary coil 3 and the number of turns of the secondary coil 4 is outputted from the secondary coil 4 side against an applied voltage on the primary coil 3. Because the transformer apparatus 1 can set the number of turns of the secondary coil 4 by the unit of 0.25, the degree of freedom of the setting of the turn ratio between the primary coil 3 and the secondary coil 4 becomes large. Consequently, in the transformer apparatus 1, the measures of the increase of the switching frequency become easy, and the improvement of the efficiency of the switching control circuit thereof may be achieved. Moreover, the miniaturization of the transformer itself and the switching control circuit can be achieved owing to the decrease of the inductances thereof.

As described above, the transformer apparatus 1 is configured in such a way that the first plate coil member 5 and the second plate coil member 6 are combined in a laminated state on the core member 2 to connect each opposed side portion 18–21 and 23–26, respectively, with the first connecting coil piece 8 to fourth connecting coil piece 11, or that the third plate coil member 35 equipped with suitable connecting coil pieces 38*a* and 35*b* are combined with the first plate coil member 5 and the second plate coil member 6 in a laminated state. Consequently, in the transformer apparatus 1, the troublesome wiring treatment of coils to each of the core portions 14–17 in a narrow space is streamlined, and the number of turns can precisely be managed.

The aforesaid transformer apparatus 1 is configured to connect the second plate coil member 6 with the first coil member 5 by means of the first connecting-coil piece 8 to the fourth connecting coil piece 11 that are fixed on the first side portion 23 to the fourth side portion 26 of the second plate coil member 6, respectively, in a severally cantilevered state. In the transformer apparatus 1, the connection processes of the first connecting coil piece 8 to the fourth connecting coil piece 11 with each of the side portions 18–21 of the first plate coil member 5 are performed in the state that the first plate coil member 5 and the second plate coil member 6 are laminated.

Figure 6:
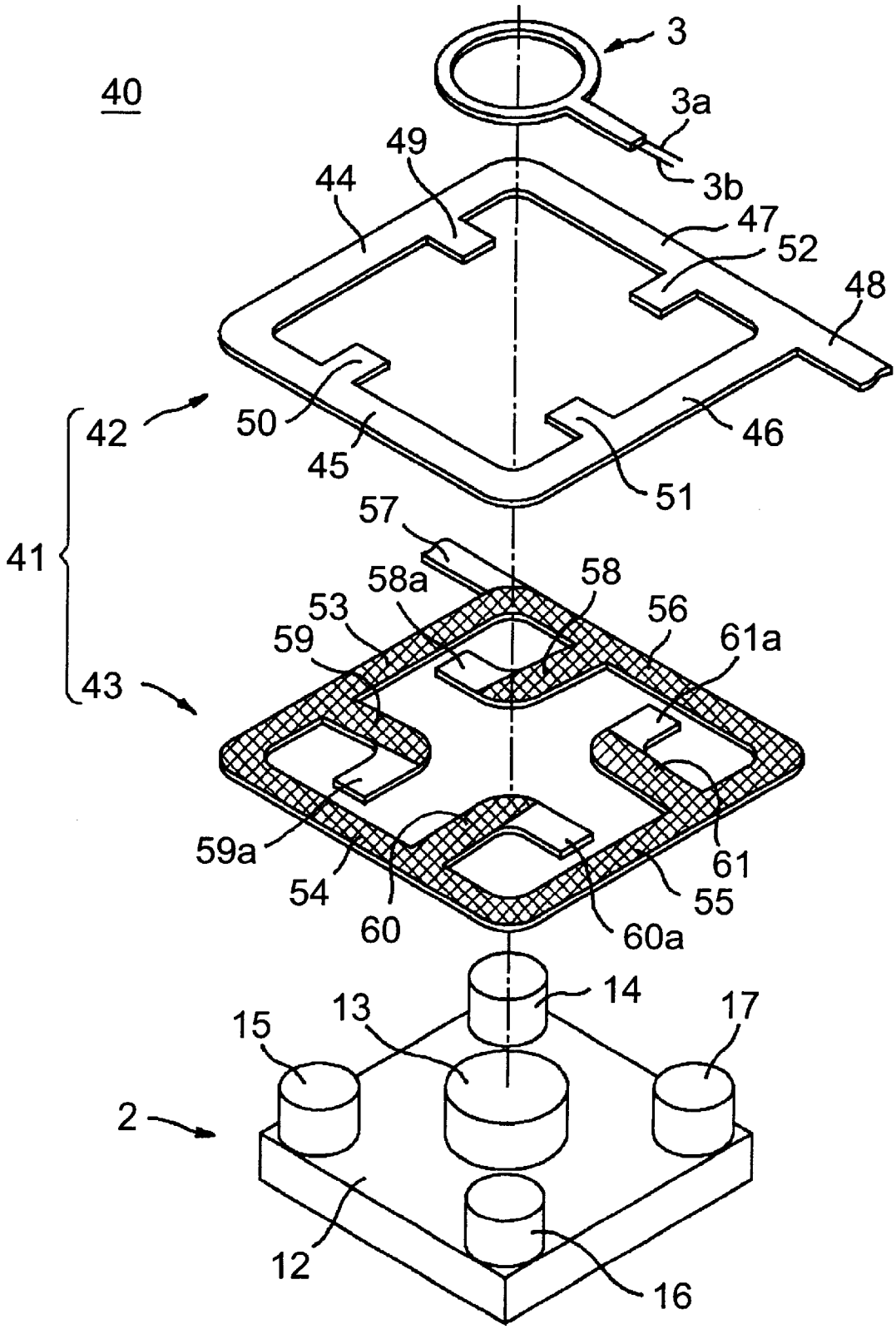
FIG. 6 is a disassembled perspective view of principal parts of a transformer apparatus as another embodiment of the present invention.

A transformer apparatus 40 shown in FIG. 6 as a second embodiment has a basic configuration as that of the transformer apparatus 1. That is, the transformer apparatus 40 comprises a first plate coil member 42, a second plate coil member 43 and a first connecting coil piece 58 to a fourth connecting coil piece 61. However, the configuration of the transformer apparatus 40 has a feature that the connection structure of the first plate coil member 42 with the first connecting coil piece 58 to the fourth connecting coil piece 61 is simplified. Incidentally, because the configurations of the core member 2 and the primary coil 3 of the transformer apparatus 40 is the same as those of the transformer apparatus 1, the description thereof is omitted.

The first plate coil member 42 has the same basic configuration as that of the aforesaid first plate coil member 5 of the transformer apparatus 1. That is, the first plate coil member 42 is composed of a first side portion 44 to a fourth side portion 47, and the side portions 44–47 constitute a substantially frame-like body as a whole including an opening portion large enough to enclose the first side core portion 14 to the fourth side core portion 17 of the core member 2. Moreover, the first plate coil member 42 includes a first terminal side portion 48 formed in the side direction of the fourth side portion 47 to be connected with a secondary circuit portion. The configuration of the first plate coil member 42 has a feature that a first connecting projecting portion 49 to a fourth connecting projecting portion 52 are severally formed to protrude from inner side edges of the first side portion 44 to the fourth side portion 47 to be one body respectively.

The second plate coil member 43 also has the same basic configuration as that of the aforesaid second plate coil member 6 of the transformer apparatus 1. That is, the second plate coil member 43 is composed of a first side portion 53 to a fourth side portion 56, and the side portions 53–56 constitute a substantially frame-like body as a whole including an opening portion large enough to enclose the first side core portion 14 to the fourth side core portion 17 of the core member 2. Moreover, the second plate coil member 43 includes a second terminal side portion 57 formed in the side direction of the fourth side portion 56 to be connected with the secondary circuit portion. The configuration of the second plate coil member 43 has a feature that a first connecting coil piece portion 58 to a fourth connecting coil piece portion 61 are severally formed to protrude from inner side edges of the first side portion 53 to the fourth side portion 56 to be one body respectively.

The first connecting coil piece portion 58 to the fourth connecting coil piece portion 61 are respectively formed in an L-letter shape having integrated two sides respectively longer than the external diameter of each of the side core portions 14–17 in an orthogonally crossed state to each other. Each of free end portions 58*a* to 61*a* of the first connecting coil piece portion 58 to the fourth connecting coil piece portion 61 is opposed to the inner side edge of adjoining side portions 53–56, respectively, and insulating layers are formed on the surfaces of the first connecting coil piece portion 58 to the fourth connecting coil piece portion 61 except for the free end portions 58*a*–61*a*. Each of the free end portions 58*a*–61*a* of the first connecting coil piece portion 58 to the fourth connecting coil piece portion 61 is respectively opposed to the first connecting projecting portion 49 to the fourth connecting projecting portion 52 of the first plate coil member 42 in a state that the second plate coil member 43 is combined with the first plate coil member 42.

The transformer apparatus 40 is configured to incorporate the second plate coil portion member 43 on the base portion 12 of the core member 2 and to combine the first plate coil member 42 to be superposed on the second plate coil member 43. In the transformer apparatus 40, the first side core portion 14 to the fourth side core portion 17 of the core member 2 respectively penetrates space portions formed by the first side portion 53 to the fourth side portion 56 of the second plate coil member 43 and the first connecting coil piece portion 58 to the fourth connecting coil piece portion 61, respectively.

In the transformer apparatus 40, as described above, each of the free end portions 58*a*–61*a* of the first connection coil piece portion 58 to the fourth connection coil portion 61 are respectively superposed on the first connecting projecting portion 49 to the fourth connecting projecting portion 52 in the state that the first plate coil member 42 is combined with the second plate coil member 43. Because the insulating layers on the surfaces of the free end portions 58*a*–61*a* of the first connecting coil piece portion 58 to the forth connecting coil piece portion 61 are exfoliated, the first connecting coil piece portion 58 to the forth connecting coil piece portion 61 are electrically conducted with the opposed first connecting projecting portion 49 to the fourth connecting projecting portion 52, respectively.

In the transformer apparatus 40, the free end portions 58*a*–61*a* of the first connecting coil piece portion 58 to the fourth connecting coil piece portion 61 are electrically and mechanically fixed on the first connecting projecting portion 49 to the fourth connecting projecting portion 52, respectively, by spot welding or other methods. Consequently, in the transformer apparatus 40, by the combination of the first plate coil member 42 and the second plate coil member 43 in their superposed state, the first unit secondary coil 28 to the fourth unit secondary coil 31 corresponding to the first side core portion 14 to the fourth side core portion 17, respectively, are constituted. When the transformer apparatus 40 is compared with the aforesaid transformer apparatus 1, the transformer apparatus 40 does not need the operation of taking out the first connecting coil piece 8 to the fourth connecting coil piece 11. Consequently the assembling processes of the transformer apparatus 40 can be performed more simply and easily.

Incidentally, although the aforesaid embodiments are configured to make it possible to set the winding ratio of the primary coil to the secondary coil by the unit of 0.25T by dividing the secondary coil into four unit secondary coils composed of a rectangular core member and each plate coil member, the division unit on the secondary coil side is not limited to the division into four unit secondary coils. The transformer apparatus may be configured to constitute 1/nT unit secondary coil by forming n side core portions on the core member to be one body to combine at least a pair of plate coil members with these side core portions correspondingly in a laminated state. Incidentally, the transformer apparatus preferably has n-pieces of side core portions being even numbers for the configuration of a well-balanced secondary coil.

Although the invention has been described in its preferred form with a certain degree of particularity, obviously many changes and variations are possible therein. It is therefore to be understood that the present invention may be practiced than as specifically described herein without departing from scope and the sprit thereof.

What is claimed is:

1. A transformer apparatus comprising:

a core member including a base portion, a center core portion fixed at a central part of a principal plane of the base portion to stand to be one body with the base portion, and at least three side core portions situated at regular intervals from each other around the center core portion in peripheral parts on the principal plane of the base portion and fixed to stand to be a single body with the base portion;

a primary coil of a predetermined number of turns, said primary coil being disposed at an outer periphery portion of the center core portion;

a first plate coil member formed in a basic shape of a frame-like body having side portions surrounding an outside of each of the side core portions respectively;

a second plate coil member formed in a basic shape of a frame-like body having side portions surrounding the outside of each of the side core portions respectively, said second plate coil member being combined with said first plate coil member having an insulating layer put therebetween in a laminated state; and a plurality of connecting coil pieces formed by being respectively cantilevered by each of the side portions of said second plate coil member correspondingly to each of the side core portions of said core member, said connecting coil pieces having free ends respectively, each of the free ends extending to surround an outer periphery portion of each corresponding side core portion and further extending to be opposed to each adjoining side portion, wherein the free end of each of said connecting coil piece is connected with said first plate coil member to form a unit secondary coil by means of said first plate coil member and said second plate coil member.

2. The transformer apparatus according to claim 1, wherein each of said unit secondary coil is connected in parallel to each other.

3. The transformer apparatus according to claim 2, said apparatus further comprising a third plate coil member formed in a basic shape of a frame-like body surrounding an outer periphery portion of a same number of the side core portions, said third plate coil member constituting a grouped secondary coil by being connected with said first plate coil member and said second plate coil member by being combined with them in a laminated state having an insulating layer put between said third plate coil member and one of said first and said second plate coil members, wherein the grouped secondary coil composed of said third plate coil member and the unit secondary coils composed of said second plate coil member are connected in series to each other.

* * * * *